US006928657B2

(12) United States Patent
Bell et al.

(10) Patent No.: US 6,928,657 B2
(45) Date of Patent: Aug. 16, 2005

(54) FACE MASK HAVING HOOK AND LOOP TYPE FASTENER

(75) Inventors: Daryl Steven Bell, Appleton, WI (US); Naveen Agarwal, Atlanta, GA (US); Michael Andrew Amante, Arlington, VA (US); Jeffrey M. Willis, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/281,512

(22) Filed: Oct. 25, 2002

(65) Prior Publication Data

US 2004/0078869 A1 Apr. 29, 2004

(51) Int. Cl.[7] ..... A42B 1/00; A62B 18/08

(52) U.S. Cl. ..... 2/9; 2/206; 128/206.12; 128/206.19; 128/206.21

(58) Field of Search ..... 2/9, 206; 128/206.12, 128/206.13, 206.17, 206.19, 206.24, 206.28; 24/442

(56) References Cited

U.S. PATENT DOCUMENTS

| | | | | |
|---|---|---|---|---|
| 2,142,282 A | | 1/1939 | Norton | |
| 2,634,725 A | * | 4/1953 | Lo Presti | 128/206.19 |
| 3,338,992 A | | 8/1967 | Kinney | |
| 3,341,394 A | | 9/1967 | Kinney | |
| 3,502,763 A | | 3/1970 | Hartmann | |
| 3,542,615 A | | 11/1970 | Dobo et al. | |
| D224,277 S | | 7/1972 | Venaleck | |
| 3,692,618 A | | 9/1972 | Dorschner et al. | |
| 3,768,100 A | * | 10/1973 | Colman et al. | 2/9 |
| 3,802,817 A | | 4/1974 | Matsuki et al. | |
| 3,849,241 A | | 11/1974 | Butin et al. | |
| 3,886,597 A | | 6/1975 | Dupre | |
| 3,953,566 A | | 4/1976 | Gore | |
| 4,014,047 A | | 3/1977 | Zobel | |
| 4,084,585 A | | 4/1978 | Venaleck | |

(Continued)

FOREIGN PATENT DOCUMENTS

| | | | | |
|---|---|---|---|---|
| EP | 0479442 A1 | | 4/1992 | |
| EP | 0280998 B1 | | 10/1992 | |
| GB | 2299762 A | | 10/1996 | |
| JP | 09313631 A | * | 12/1997 | A62B/18/02 |

OTHER PUBLICATIONS

PCT International Search Report, Dec. 12, 2003.
Japanese Abstract 03119164A, May 21, 1991.
Japanese Abstract 08113861 A, May 7, 1996.
Japanese Abstract 08170262 A, Jul. 2, 1996.
Japanese Abstract 09095846 A, Apr. 8, 1997.
Japanese Abstract 10099458 A, Apr. 21, 1998.
Japanese Abstract 20011245999 A, Sep. 11, 2001.
U.S. Appl. No. 10/281,511, filed Oct. 25, 2002.
U.S. Appl. No. 10/325,247, filed Dec. 19, 2002.

*Primary Examiner*—Rodney M. Lindsey
(74) *Attorney, Agent, or Firm*—Dority & Manning, P.A.

(57) ABSTRACT

A face mask is provided. The face mask includes a body portion that is configured to be placed over a mouth and at least part of a nose of a user. A first extension portion is present and is attached to the body potion. The first extension portion is configured to at least partially extend around at least a portion of a head of the user. A second extension portion is attached to the body portion. Also, a hook and loop type fastener is present and has a hook section and a loop section. One of the hook and loop sections is attached to the first extension portion, and the other of the hook and loop sections is attached to the second extension portion. Engagement of the hook section and the loop section causes the body portion, the first extension portion, and the second extension portion to be retained on the user. Disengagement of the hook section and the loop section causes the body portion, the first extension portion, and the second extension portion to be released from the user.

26 Claims, 6 Drawing Sheets

U.S. PATENT DOCUMENTS 4,100,324 A 7/1978 Anderson et al.
4,187,390 A 2/1980 Gore
4,195,629 A 4/1980 Halford
4,215,682 A 8/1980 Kubik et al.
4,300,240 A * 11/1981 Edwards ..... 2/206
4,340,563 A 7/1982 Appel et al.
4,374,888 A 2/1983 Bornslaeger
4,375,718 A 3/1983 Wadsworth et al.
4,443,513 A 4/1984 Meitner et al.
4,520,509 A 6/1985 Ward
4,550,856 A 11/1985 Ballmann et al.
4,592,815 A 6/1986 Nakao
4,631,933 A 12/1986 Carey, Jr.
4,641,379 A 2/1987 Martin
4,652,487 A 3/1987 Morman
4,655,760 A 4/1987 Morman et al.
4,657,802 A 4/1987 Morman
4,720,415 A 1/1988 Vander Wielen et al.
4,781,966 A 11/1988 Taylor
4,789,699 A 12/1988 Kieffer et al.
4,790,307 A 12/1988 Haber et al.
4,802,473 A 2/1989 Hubbard et al.
4,818,464 A 4/1989 Lau
4,825,474 A * 5/1989 Edwards ..... 2/206
4,874,659 A 10/1989 Ando et al.
4,891,957 A 1/1990 Strack et al.
4,965,122 A 10/1990 Morman
4,969,457 A 11/1990 Hubbard et al.
4,981,747 A 1/1991 Morman
5,020,533 A 6/1991 Hubbard et al.
5,035,006 A 7/1991 Hetz et al.
5,107,547 A 4/1992 Scheu
5,114,781 A 5/1992 Morman
5,214,804 A 6/1993 Carey et al.
5,226,992 A 7/1993 Morman
5,244,482 A 9/1993 Hassenboehler, Jr. et al.
5,265,280 A 11/1993 Walsh
5,322,061 A 6/1994 Brunson
5,336,545 A 8/1994 Morman
5,383,450 A 1/1995 Hubbard et al.
5,401,446 A 3/1995 Tsai et al.
5,401,466 A 3/1995 Foltz et al.
5,425,380 A 6/1995 Hudson et al.
5,492,753 A 2/1996 Levy et al.
5,493,753 A 2/1996 Rostamo
5,540,976 A 7/1996 Shawver et al.
5,553,608 A 9/1996 Reese et al.
5,628,308 A * 5/1997 Harges et al. ..... 128/206.21
5,681,645 A 10/1997 Strack et al.
5,693,401 A * 12/1997 Sommers et al. ..... 428/100
5,699,791 A 12/1997 Sukiennik et al.
5,717,991 A 2/1998 Nozaki et al.
5,813,398 A 9/1998 Baird et al.
5,817,584 A 10/1998 Singer et al.
5,819,935 A 10/1998 Lawson
5,845,340 A * 12/1998 Frislie ..... 2/202
5,863,312 A 1/1999 Wolfe
5,934,275 A 8/1999 Gazzara
6,119,691 A 9/2000 Angadjivand et al.
6,148,817 A 11/2000 Bryant et al.
6,162,535 A 12/2000 Turkevich et al.
6,338,340 B1 * 1/2002 Finch et al. ..... 128/205.27
6,474,336 B1 11/2002 Wolfe
6,524,294 B1 * 2/2003 Hilston et al. ..... 604/386
6,543,450 B1 * 4/2003 Flynn ..... 128/206.19
6,615,838 B1 9/2003 Tsai
6,632,212 B1 10/2003 Morman et al.
6,644,314 B1 11/2003 Elsberg
6,656,403 B1 * 12/2003 Clune et al. ..... 264/167
2002/0162556 A1 * 11/2002 Smith et al. ..... 128/207.12
2003/0045856 A1 * 3/2003 Couture et al. ..... 604/391

* cited by examiner

FACE MASK HAVING HOOK AND LOOP TYPE FASTENER

BACKGROUND

Face masks find utility in a variety of manufacturing, custodial, and household applications. In these types of applications, face masks filter out dust and other contaminates to facilitate easier breathing on the part of the user. Likewise, face masks have found utility in the healthcare industry. In this regard, face masks are helpful in that they may be configured to filter exhaled air from the wearer to minimize the amount of bacteria or other contaminants released from the user into the environment. Such a limitation of bacteria contaminants is important in that typically hospital patients require a sterile environment in order to avoid infections, and hospital patients typically have compromised immune systems making them susceptible to infection. Additionally, face masks may also filter inhaled air to protect the user from contaminants that may be found in a hospital setting, as hospital patients commonly carry airborne bacterial pathogens.

It is therefore the case that in the health care field, specifically in operating rooms, health care providers often use face masks to protect themselves from acquiring harmful diseases such as AIDS and hepatitis along with other contagious diseases that may be present in the patients that are being treated.

Face masks have also been designed in order to provide a tight sealing arrangement. Such a sealing arrangement may prove useful in preventing the transfer of pathogens that reside in bodily fluids or other liquids. As such, face masks have been designed in order to prevent airborne pathogens and/or pathogens in fluids from being transferred to and/or from the health care provider.

Some face masks are configured to cover the entire face of a user while other face masks are designed to cover only the nose and mouth of the user. Additionally, face masks have been designed to cover various parts of a user's face. For instance, certain face masks are configured for covering the nose, eyes, and mouth of a user. The section of the face mask that covers the nose and mouth typically is composed of a material that prevents the passage of germs and other contaminants therethrough but allows for the passage of air so that the user may breathe. This section is typically known as a front panel or body portion. Attached to this front panel is a securing device that is used for attaching the front panel securely to the head of the user. For instance, manual tie straps are often employed. For this purpose the front panel of the face mask is placed on the face of the user and the tie straps are extended around the head of the user and tied to fasten the face mask to the user.

Such a fastening arrangement may be problematic in that the user must reach around his or her head in order to tie these straps to one another. In fact, it is sometimes the case that assistance is needed in order to conduct this type of fastening. Solo fastening of the face mask to the face of the user is problematic in that the user's hands may touch his or her head, or hair, or may contact other objects. This touching increases the likelihood of germs being passed onto the hands of the user and subsequently exposes the patient to a greater risk of infection.

Additionally, the use of manual tie straps is problematic in that such a fastening arrangement is typically slow and time consuming. This can be a problem when, for instance, the healthcare provider is faced with an emergency situation in which time is of the essence.

A prior art face mask 10 is shown in FIG. 1. Here, the face mask 10 is attached to the user 12 by way of a pair of manual tie straps 14. In order to affix the manual tie straps 14, the user 12 must reach around his head to affect the tying of the manual tie straps 14. This type of fastening arrangement is undesirable because it is slow, awkward, and may provide for contamination through contact of the hair 16 of the user 12 and the hands of the user 12.

Also, manual tie straps are problematic on face masks in that the face mask may become loose during normal use and require adjusting. In order to readjust the face mask, the user must untie the manual tie straps and then retie them. Such a situation is similar to one retying his or her shoes, and is obviously undesirable in that it is a time consuming process and annoying.

Attempts have been made in the art in order to eliminate manual tie straps on face masks. For instance, the art sometime employs extensions from the front panel of the face mask that have loops or other structure that is designed to hook around the ears of the user. These types of fastening arrangements are undesirable in that they do not allow for the face mask to be used on users of different size. In effect, they only allow for the use on one size of wearer. Also, users of face masks having loop or other structure that is designed to fasten onto the ear of the user is undesirable because users have found it to be uncomfortable having these structures in contact with their ears.

Also, the aforementioned risks of contamination from the head, hair, or other objects onto the hands of the user during attachment of the face mask, as mentioned above, is still present in face masks having this type of attaching feature. Finally, face masks having loops or other structure designed to attach to the ears of the user are problematic in that the face mask may not be adjusted if the face mask becomes loose during normal use.

Also, the use of loop or other structure designed to attach to the ear of the user suffers from the disadvantage of requiring an extended amount of time in order to properly loop or hook the structure around each ear of the user, and to adjust this structure so that it does not extremely irritate the user.

The present invention provides for a face mask having a hook and loop type fastener that alleviates problems encountered with the fastening arrangements found in prior face masks.

SUMMARY

Various features and advantages of the invention will be set forth in part in the following description, or may be obvious from the description, or may be learned from practice of the invention.

The present invention provides for a face mask that includes a body portion that is configured to be placed over a mouth and at least part of a nose of a user. The body portion at least partially isolates the mouth and at least part of the nose of the user from the environment. A leg extension portion is attached to the body portion and extends around at least a portion of the left side of the users head. Similarly, a right extension portion is attached to the body portion and extends around at least a portion of the right side of the user's head. A hook and loop type fastener is employed. The hook section of the fastener is attached to one of either the right or left extension portions, and the loop section is attached to the other of the right or left extension portion. Engagement of the hook and loop type sections causes the left and right extension portions to be connected to one another, and causes the body portion along with the right and left extension portions to be retained on the user.

Other exemplary embodiments of the present invention reside in a face mask as described above where the left and/or right extension portion is formed integrally with the body portion, and is made of the same material as at least a portion of the body portion. Also, further exemplary embodiments of the present invention exists in a face mask as described above where the hook and/or loop section is formed integrally with the right and/or left extension portions.

Further, the hook sections and loop sections may be separate components that are attached to either the right or left extension portions in other exemplary embodiments of the present invention.

Also, an exemplary embodiment of the present invention exists in a face mask that has a body portion along with a first and second extension portion that is attached to the body portion. The first extension portion is configured to at least partially extend around at least a portion of a head of the user. A hook and loop type fastener is employed where one of the hook and loop sections is attached to the first extension portion and the other of the hook and loop sections is attached to the second extension portion. Engagement of these two sections causes the body portion, the first extension portion, and the second extension portion to be retained on the user. Disengagement of these two sections causes the aforementioned portions to be released from the user.

DEFINITIONS

As used herein, the term "nonwoven fabric or web" means a web having a structure of individual fibers or threads which are interlaid, but not in an identifiable manner as in a knitted fabric. Nonwoven fabrics or webs have been formed from various processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the contents of which are incorporated herein by reference in their entirety. Spunbond fibers are generally continuous and have diameters generally greater than about 7 microns, more particularly, between about 10 and about 20 microns. As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al., the content of which is incorporated herein by reference in its entirety. Meltblown fibers are microfibers which may be continuous or discontinuous with diameters generally less than 10 microns.

As used herein, the term "composite" refers to a material which may be a multicomponent material or a multilayer material. These materials may include, for example, stretch bonded laminates, neck bonded laminates, or any combination thereof.

As used herein, the term "stretch bonded laminate" refers to a composite material having at least two layers in which one layer is a gatherable layer and the other layer is an elastic layer. The layers are joined together when the elastic layer is extended from its original condition so that upon relaxing the layers, the gatherable layer is gathered. Such a multilayer composite elastic material may be stretched to the extent that the nonelastic material gathered between the bond locations allows the elastic material to elongate. One type of stretch bonded laminate is disclosed, for example, by U.S. Pat. No. 4,720,415 to Vander Wielen et al., the content of which is incorporated herein by reference in its entirety. Other composite elastic materials are disclosed in U.S. Pat. No. 4,789,699 to Kieffer et U.S. Pat. No. 4,781,966 to Taylor and U.S. Pat. Nos. 4,657,802 and 4,652,487 to Morman and U.S. Pat. No. 4,655,760 to Morman et al., the contents of which are incorporated herein by reference in their entirety.

As used herein, the terms "necking" or "neck stretching" interchangeably refer to a method of elongating a nonwoven fabric, generally in the machine direction, to reduce its width (cross-machine direction) in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.6 times. When relaxed, the web retracts toward, but does not return to, its original dimensions. Such a process is disclosed, for example, in U.S. Pat. No. 4,443,513 to Meitner and Notheis, U.S. Pat. Nos. 4,965,122, 4,981,747 and 5,114,781 to Morman and U.S. Pat. No. 5,244,482 to Hassenboehler Jr. et al., the contents of which are incorporated herein by reference in their entirety.

As used herein, the term "necked material" refers to any material which has undergone a necking or neck stretching process.

As used herein, the term "reversibly necked material" refers to a material that possesses stretch and recovery characteristics formed by necking a material, then heating the necked material, and cooling the material. Such a process is disclosed in U.S. Pat. No. 4,965,122 to Morman, commonly assigned to the assignee of the present invention, and incorporated by reference herein in its entirety. As used herein, the term "neck bonded laminate" refers to a composite material having at least two layers in which one layer is a necked, non-elastic layer and the other layer is an elastic layer. The layers are joined together when the non-elastic layer is in an extended (necked) condition. Examples of neck-bonded laminates are such as those described in U.S. Pat. Nos. 5,226,992, 4,981,747, 4,965,122 and 5,336,545 to Morman, the contents of which are incorporated herein by reference in their entirety.

As used herein, the term "coform" means a meltblown material to which at least one other material is added during the meltblown material formation. The meltblown material may be made of various polymers, including elastomeric polymers. Various additional materials may be added to the meltblown fibers during formation, including, for example, pulp, superabsorbent particles, cellulose or staple fibers. Coform processes are illustrated in commonly assigned U.S. Pat. No. 4,818,464 to Lau and U.S. Pat. No. 4,100,324 to Anderson et al., the contents of which are incorporated herein by reference in their entirety.

As used herein, the term "stitchbonded" refers to a process in which materials (fibers, webs, films, etc.) are joined by stitches sewn or knitted through the materials. Examples of such processes are illustrated in U.S. Pat. No. 4,891,957 to Strack et al. and U.S. Pat. No. 4,631,933 to Carey, Jr, the contents of which are incorporated herein by reference in their entirety.

As used herein, the term "ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the content of which is incorporated herein by reference in its entirety.

As used herein, the term "thermal point bonding" involves passing materials (fibers, webs, films, etc.) to be bonded between a heated calender roll and an anvil roll. The calender roll is usually, though not always, patterned in some way so that the entire fabric is not bonded across its entire surface, and the anvil roll is usually flat. As a result, various patterns for calender rolls have been developed for functional as well as aesthetic reasons. Typically, the percent bonding area varies from around 10 percent to around 30 percent of the area of the fabric laminate. As is well known in the art, thermal point bonding holds the laminate layers together and imparts integrity to each individual layer by bonding filaments and/or fibers within each layer.

As used herein, the term "elastic" refers to any material, including a film, fiber, nonwoven web, or combination thereof, which upon application of a biasing force, is stretchable to a stretched, biased length which is at least about 150 percent, or one and a half times, its relaxed, unstretched length, and which will recover at least 15 percent of its elongation upon release of the stretching, biasing force.

As used herein, the term "extensible and retractable" refers to the ability of a material to extend upon stretch and retract upon release. Extensible and retractable materials are those which, upon application of a biasing force, are stretchable to a stretched, biased length and which will recover a portion, preferably at least about 15 percent, of their elongation upon release of the stretching, biasing force.

As used herein, the terms "elastomer" or "elastomeric" refer to polymeric materials that have properties of stretchability and recovery.

As used herein, the term "stretch" refers to the ability of a material to extend upon application of a biasing force. Percent stretch is the difference between the initial dimension of a material and that same dimension after the material has been stretched or extended following the application of a biasing force. Percent stretch may be expressed as [(stretched length−initial sample length)/initial sample length]×100. For example, if a material having an initial length of one (1) inch is stretched 0.50 inch, that is, to an extended length of 1.50 inches, the material can be said to have a stretch of 50 percent.

As used herein, the term "recover" or "recovery" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "electret" or "electret treating" refers to a treatment that imparts a charge to a dielectric material, such as a polyolefin. The charge includes layers of positive or negative charges trapped at or near the surface of the polymer, or charge clouds stored in the bulk of the polymer. The charge also includes polarization charges which are frozen in alignment of the dipoles of the molecules. Methods of subjecting a material to electret treating are well known by those skilled in the art. These methods include, for example, thermal, liquid-contact, electron beam, and corona discharge methods. One particular technique of subjecting a material to electret treating is disclosed in U.S. Pat. No. 5,401,466, the contents of which is herein incorporated in its entirety by reference. This technique involves subjecting a material to a pair of electrical fields wherein the electrical fields have opposite polarities.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, any given range is intended to include any and all lesser included ranges. For example, a range of from 45–90 would also include 50–90; 45–80; 46–89; and the like.

DETAILED DESCRIPTION

Figure 1:
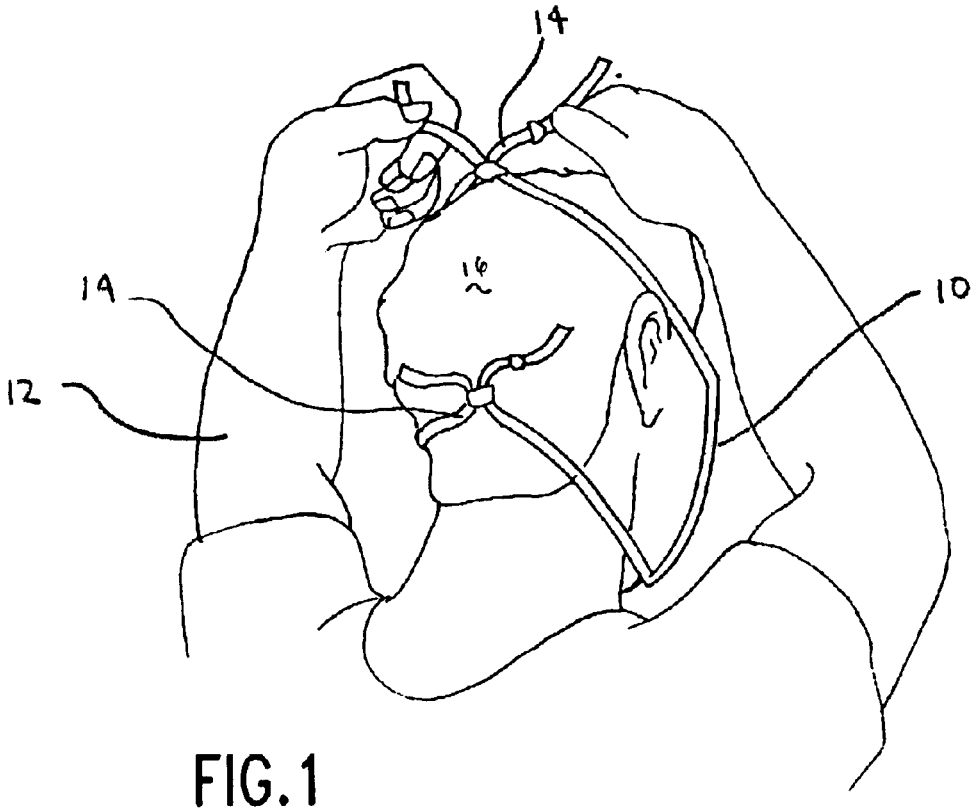
FIG.1 PRIOR ART
FIG. 1 is a perspective view of a prior face mask wherein the face mask is attached to the user through the use of manual tie straps.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 2:
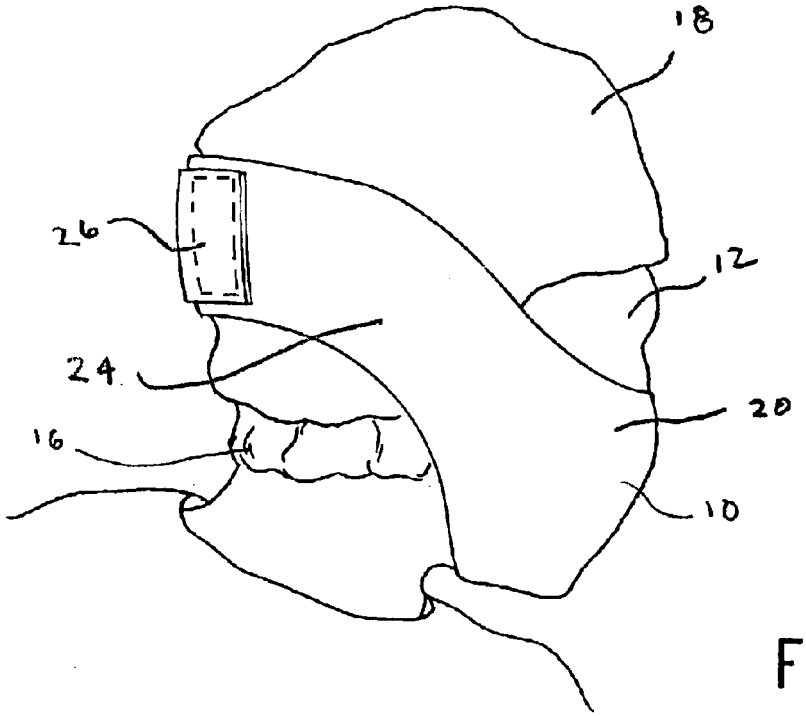
FIG. 2 is a perspective view of an exemplary embodiment of a face mask in accordance with the present invention. Here, the face mask is attached to the user by way of a hook and loop type fastener.
Figure 3:
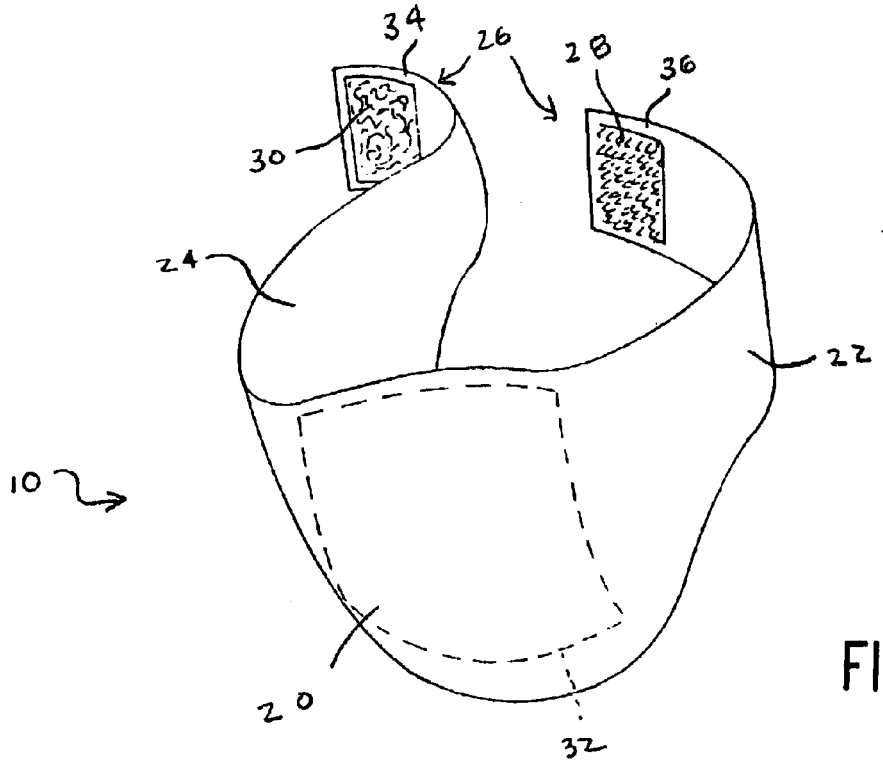
FIG. 3 is a perspective view of an exemplary embodiment of a face mask in accordance with the present invention.

A face mask 10 in accordance with the present invention is shown in FIG. 2. The face mask 10 includes a body portion 20 that is configured to be placed over the mouth and at least part of the nose of a user 12. The face mask 10 at least partially isolates the mouth and nose of the user 12 from the environment. The face mask 10 is shown in greater detail in FIG. 3. Here, a filter 32 is shown being present within the body portion 20. The filter 32 may be carried on the outside surface, the inside surface, or within the body portion 20. The filter 32 may be configured in order to prevent the passage of pathogens through the face mask 10, but allow for the passage of air through the face mask 10 in order to permit the user 12 to breath. As seen in FIG. 3, the body portion 20 has a first extension portion 24 extending from one side and a second extension portion 22 extending from an opposite side. The first extension portion 24 may be a right extension portion 24 in certain exemplary embodiments of the present invention. Also, the second extension portion 22 may be a left extension portion 22 in other certain exemplary embodiments of the present invention. The left and right extension portions 22 and 24 may be integrally formed with the body portion 20 or may be separate pieces that are attached to the body portion 20 in other exemplary embodiments of the present invention.

A hook and loop type fastener 26 is present on the face mask 10. As can be seen in FIG. 3, the hook and loop type fastener 26 includes a hook section 28 that is attached to the end 36 of the left extension portion 22. Also, the hook and loop type fastener 26 includes a loop section 30 that is attached to an end 34 of the right extension portion 24. Hook and loop type fasteners are commonly known in the art. The hook section 28 includes a plurality of hooks that extend generally perpendicularly to the end 36 of the left extension portion 22. The loop section 30 of the hook and loop type fastener 26 includes a series of generally softer loops that extend from the surface of the end 34 of the right extension portion 24. The hook and loop type fastener 26 is shown in an unattached arrangement in FIG. 3, and is shown in an attached arrangement in FIG. 2.

As can be seen in FIG. 2, the hair 16 of the user 12 is substantially covered by a hair cap 18. The face mask 10 is attached to the user 12 and extends over the hair cap 18. The face mask 10 is shown as being attached such that the hook and loop type fastener 26 retains the face mask 10 onto the user 12. The use of the hook and loop type fastener 26 allows for the user 12 to quickly and easily attach the face mask 10 to his or her face. The user 12 only needs to place the face mask 10 around his or her face and position the right extension portion 24 and the left extension portion 22 (not shown in FIG. 2) around his or her head and engage the hook and loop type fastener 26. This type of an arrangement is faster because knots and/or other fastening arrangements do not need to be employed. In order to fasten the hook and loop type fastener 26, the user 12 simply needs to engage the hook section 28 and the loop section 30 (not shown in FIG. 2).

Engagement of the hook and loop type fastener 26 causes the left and right extension portions 22 and 24 to be connected to one another and causes the body portion 20 along with the right and left extension portions 24 and 22 to be retained on the user 12.

The left extension portion 22 may be formed integrally with the body portion 20 or may be a separate piece that is connected to the body portion 20. Also, these two components, the body portion 20 and the left extension portion 22 may be made of the same material. However, other exemplary embodiments of the present invention exists where the left extension portion 22 and/or the body portion 20 are made of different materials. Also, the right extension portion 24 may be formed in a similar fashion. That is, the right extension portion 24 may be integrally formed with the body portion 20 or may be a separate piece that is connected thereto. Also, the right extension portion 24 may be made of the same material as at least a portion of the body portion 20, or the two pieces may be made of the same material throughout.

Figure 4:
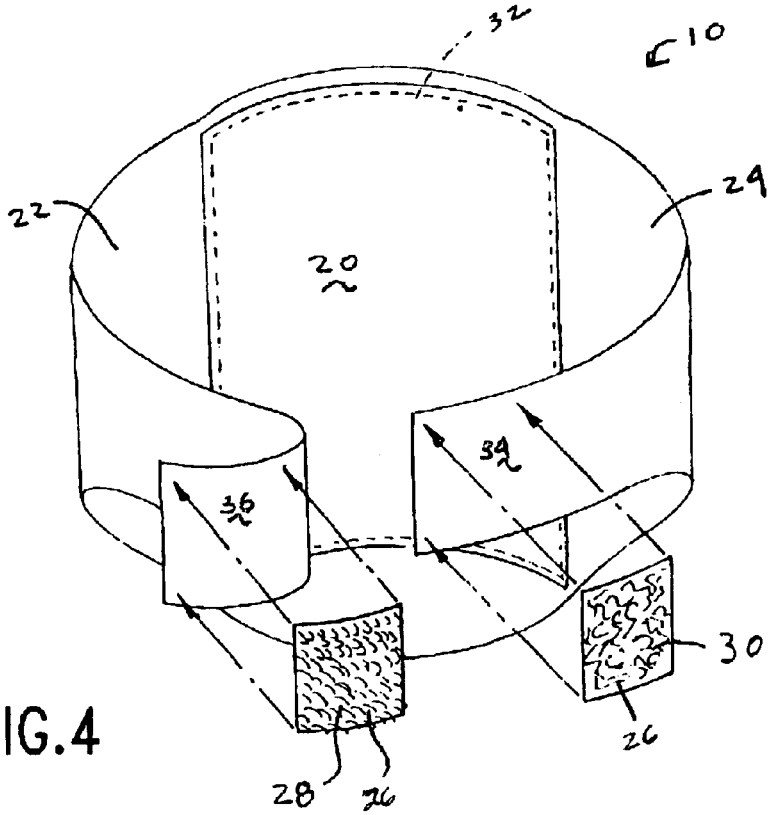
FIG. 4 is a perspective view of an exemplary embodiment of a face mask in accordance with the present invention. Here, two sections of a hook and loop type fastener are each attached to the ends of a right and left extension portion of the face mask.

FIG. 4 shows the loop section 30 being a separate component that is attached to the end 34 of the right extension portion 24. Additionally, the hook section 28 is shown as being a separate component that is attached to the end 36 of the left extension portion 22. The hook section 28 and loops section 30 may be attached to the ends 34 and 36 by adhesives, clips or other means of attachment as is commonly known in the art.

Figure 5:
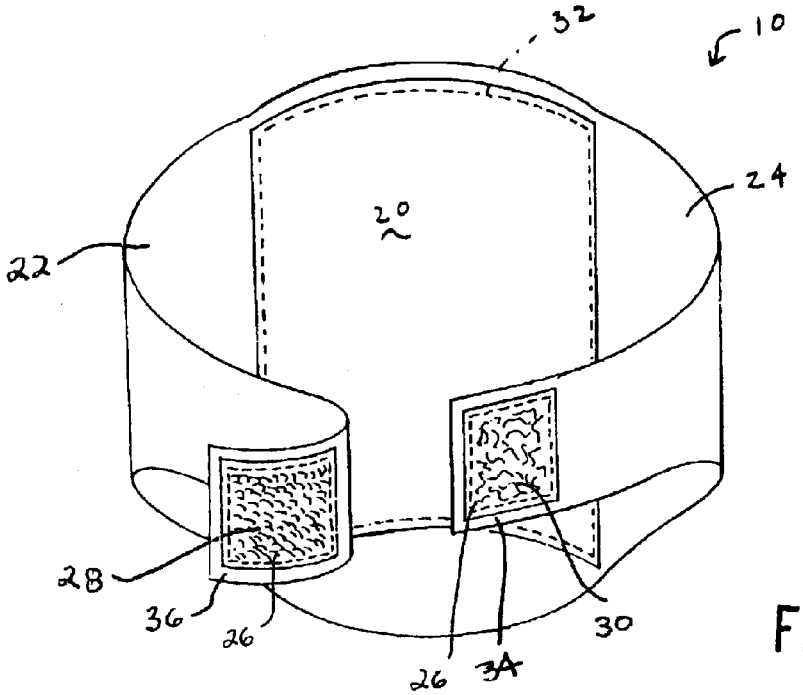
FIG. 5 is a perspective view of an exemplary embodiment of a face mask in accordance with the present invention. The hook section of the hook and loop type fastener is approximately the same size as the loop section of the hook and loop type fastener.

FIG. 5 shows an exemplary embodiment of the face mask 10 in accordance with the present invention where the hook section 28 and the loop section 30 are approximately the same size. In this case, the area of both the hook section 28 and loop section 30 are identical. The loop section 30 is a separate component and is attached to the outside of the end 34 of the right extension portion 24. The hook section 28 is a separate component and is attached to the inside of the end 36 of the left extension portion 22. It is to be understood, however, that in other exemplary embodiments of the present invention the loop section 30 may be placed on the left extension portion 22, and the hook section 28 may be placed on the end 34 of the right extension portion 24. Additionally, the hook and loop sections 28 and 30 may be placed on either the inside or the outside of the ends 34 and 36 in other exemplary embodiments of the present invention.

Although FIG. 5 shows the hook section 28 attached to the left extension portion 22, and the loop section 30 attached to the right extension portion 24, it is to be understood that in other exemplary embodiments of the present invention the hook section 28 may be attached to the right extension portion 24, and the loop section 30 attached to the left extension portion 22. Additionally, the hook section 28 and the loop section 30 may be integrally formed with either the left extension portion 22 or the right extension portion 24.

Figure 6:
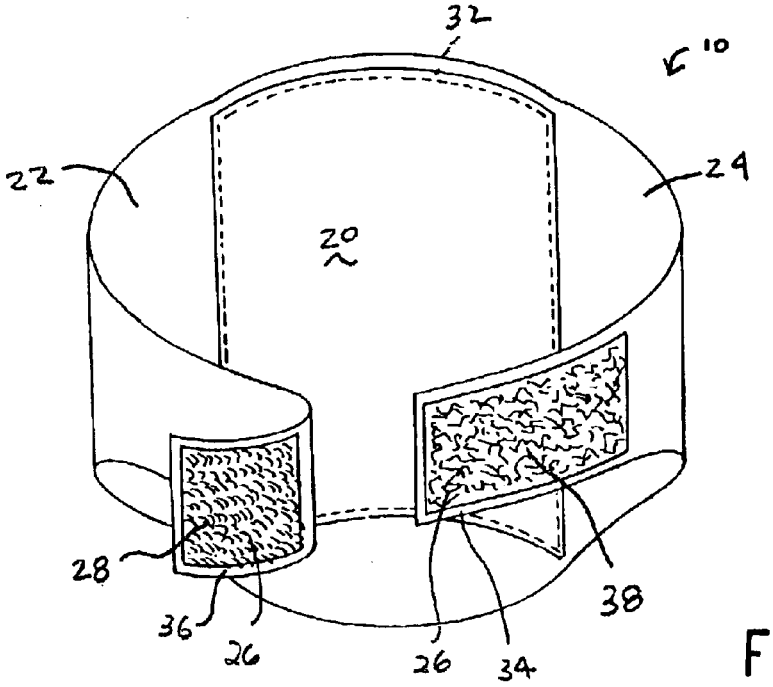
FIG. 6 is an exemplary embodiment of a face mask in accordance with the present invention. The loop section of the hook and loop type fastener is larger than the hook section of the hook and loop type fastener.

A further exemplary embodiment of the present invention is shown in FIG. 6. Here, the face mask 10 is provided with the hook section 28 on the end 36 of the left extension portion 22. The hook section 28 is on the inside of the end 36. A longer loop section 38 is provided on the outside of the end 34 of the right extension portion 24. The longer loop section 38 is of a greater area than the hook section 28. This type of an arrangement allows for an adjustment of the size of the face mask 10 on the user. For instance, if being worn by a user with a smaller head, the hook section 28 may be attached to an end of the longer loop section 38 that is closer to the body portion 20. If the face mask 10 is worn by a user 12 having a larger head, the hook section 28 may be attached to the longer loop section 38 at a portion of the longer loop section 38 that is further away from the body portion 20. The present invention includes exemplary embodiments where the loop section 30 and the hook section 28 are of substantially the same size, and exemplary embodiments wherein the two sections are of different sizes.

FIG. 6 also shows the longer loop section 38 and the hook section 28 being formed integrally with the right and left extension portions 24 and 22 respectively. As such, the present invention includes exemplary embodiments where the components of the hook and loop type fastener 26 are not separate pieces that are attached the face mask 10, but are components that are formed during the production of the face mask 10. Additionally, the hook and loop type fastener 26 may be formed from components that are incorporated into the material of the right and left extension portions 24 and 22. As such, it may be the case that the hook section 28 and/or the longer loop section 38 in FIG. 6 or the loop section 30 in FIG. 5 may extend across the entire length of the right and left extension portions 24 and 22 and do not need to be distinct sections of the right and left extension portions 24 and 22.

Figure 7:
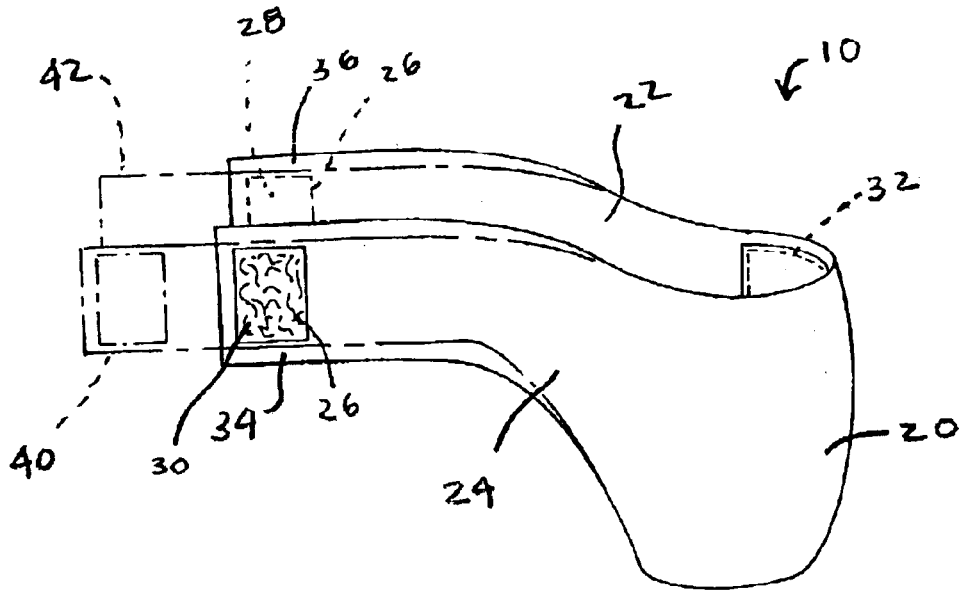
FIG. 7 is a side view of an exemplary embodiment of a face mask in accordance with the present invention. Here, the right and left extension portions of the face mask are shown as being made of an elastic material.
Figure 8:
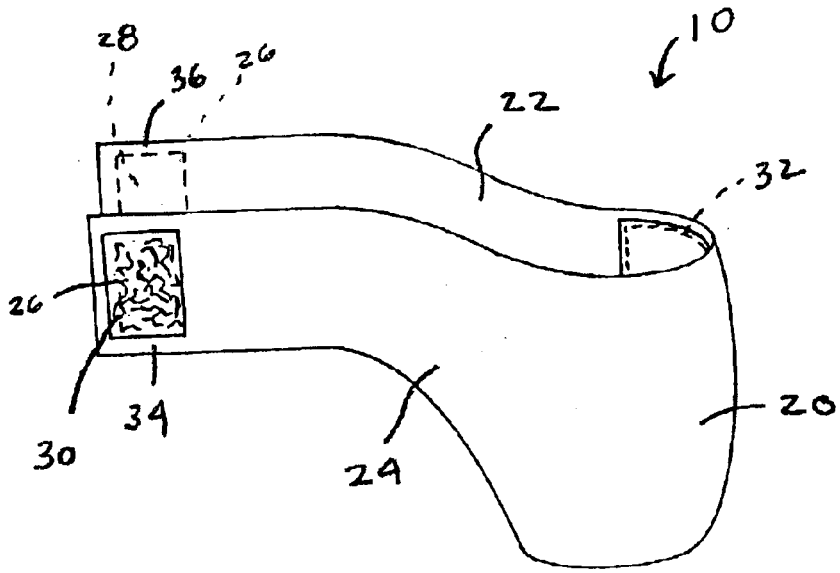
FIG. 8 is a side view of an exemplary embodiment of a face mask in accordance with the present invention. Here, the right and left extension portions are made of a relatively inelastic material.

FIG. 7 shows an alternative exemplary embodiment of the face mask 10 of the present invention. Here, the right extension portion 24 and the left extension portion 22 are made of an elastic material such that they may be stretched. For instance, the right extension portion 24 may be stretched into the stretched extension portion 40. Also, the left extension portion 22 may be stretched into the stretched left extension portion 42. Stretching of the right and left extension portions 24 and 22 allows for the face mask 10 to be more securely fastened to the user 12. Also, stretching of the right and left extension portions 24 and 22 permit the face mask 10 to be worn by users 12 of various sizes. For instance, a smaller face mask 10 may not be able to be worn on a larger user 12 unless the right and left extension portions 24 and 22 are stretched around the head of the larger user 12.

Also, the present invention includes an exemplary embodiment of the face mask 10 where the right and left extension portions 24 and 22 are not elastic members, but are relatively inelastic. This type of face mask 10 is configured to be worn by a user 12 of a particular size. However, as previously discussed, the face mask 10 may be modified in other exemplary embodiments of the present invention so that the face mask 10 may accommodate users 12 of various sizes. Therefore, the present invention includes exemplary embodiments where the face mask 10 may or may not be configured to accommodate different sized users 12.

Figure 9:
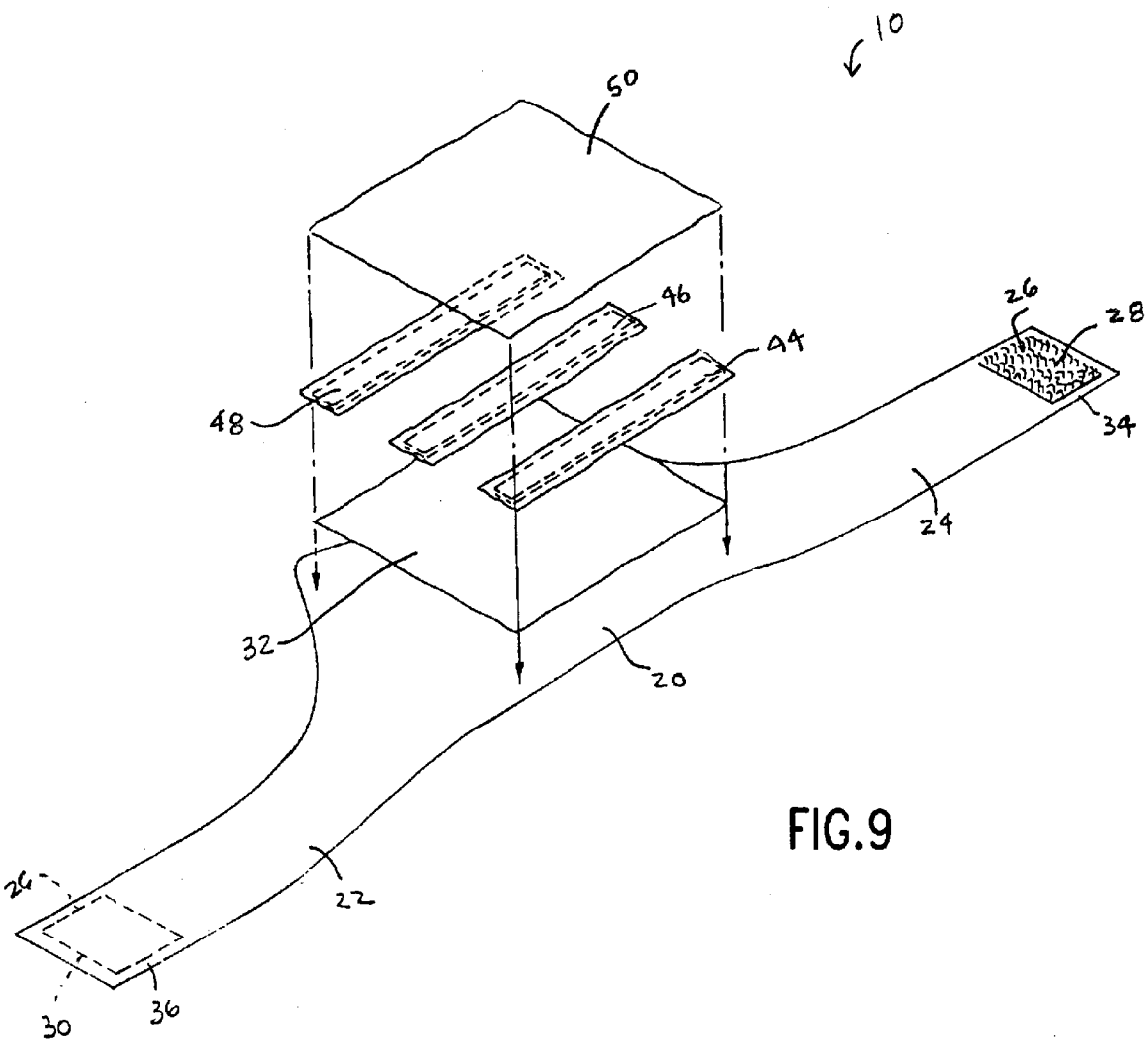
FIG. 9 is an expanded assembly view of an exemplary embodiment of a face mask in accordance with the present invention. Here, a nose stay, an intermediate stay, and a chin stay are disposed between a filter and an outer layer of the face mask.

The face mask 10 of the present invention may be constructed of a single material or may be composed of one or more materials. Additionally, the face mask 10 may be a single layer of one material, or may be composed of multiple layers of one or more different materials. Also, structural elements may be incorporated into the face mask 10 in order to provide for different desired characteristics. For instance, a series of stays may be employed within the face mask 10. FIG. 9 shows such a configuration where three stays are present. The stays are disposed between the filter 32 and an outer layer 50. A nose stay 44 is incorporated between a filter 32 and the outer layer 50. The nose stay 44 provides for structural rigidity of the body portion 20. The nose stay 44 may also help to seal the upper periphery of the body portion 20. The nose stay 44 may be shaped by the user or manufacturer in order to better conform the nose portion of the body portion 20 around the nose of the user.

Additionally, a chin stay 48 is incorporated on another end of the body portion 20, and is disposed between the filter 32 and the outer layer 50. Also, the chin stay 48 may help to seal the lower periphery of the portion 20. The chin stay may be shaped so as to provide structural rigidity to the lower portion of the body portion 20 so that the body portion 20 may be more advantageously shaped around the chin of the user 12.

Additionally, an intermediate stay 46 is present between the filter 32 and the outer layer 50. The intermediate stay 46 is disposed on the body portion 20 at about an even distance from the nose stay 44 and the chin stay 48. The intermediate stay 46 may be used in conjunction with the nose stay 44 and the chin stay 48 to provide the body portion 20 with a desired shape, such as a cavity. The stays 44, 46, and 48 may be composed of metal strips that may be bent into a desired shape and remain in their formed shape until a certain degree of force is imparted thereon. The stays 44, 46, and 48 allow for a better fit of the face mask 10 on the user 12, and also allow for the construction of a cavity around the mouth and/or nose of the user 12 so that the face mask 10 is not pressed against the mouth and/or nose of the user. Also, the stays 44, 46, and 48 may also help to provide a better seal of the face mask 10. However, it is to be understood that in other exemplary embodiments of the present invention, that the face mask 10 may be provided with any number of or no stays. A series of stays are incorporated into a face mask disclosed in U.S. Pat. No. 5,699,791, the contents of which are incorporated herein by reference in their entirety for all purposes. The '791 patent discloses a construction of body portion 20 having the stays 44, 46, and 48 incorporated therein. As such, this type of construction of the body portion 20 may be employed in the current invention in other exemplary embodiments. The hook and loop type fastener 26 in the exemplary embodiment shown in FIG. 9 operates in essentially the same way as described in regards to previous embodiments.

The stays 44, 46, and 48 may therefore help to better secure the body portion 20 to the user's 12 face and to provide an enhanced fluid seal along the periphery and other sections of the mask portion. The stays 44, 46, and 48 may be made of an elongated malleable member that allows for the configuration of the body portion 20 to closely fit the contours of the nose and cheeks of the user 12. The stays 44, 46, and 48 may be made of any malleable material, including metal wire or an aluminum band.

Figure 10:
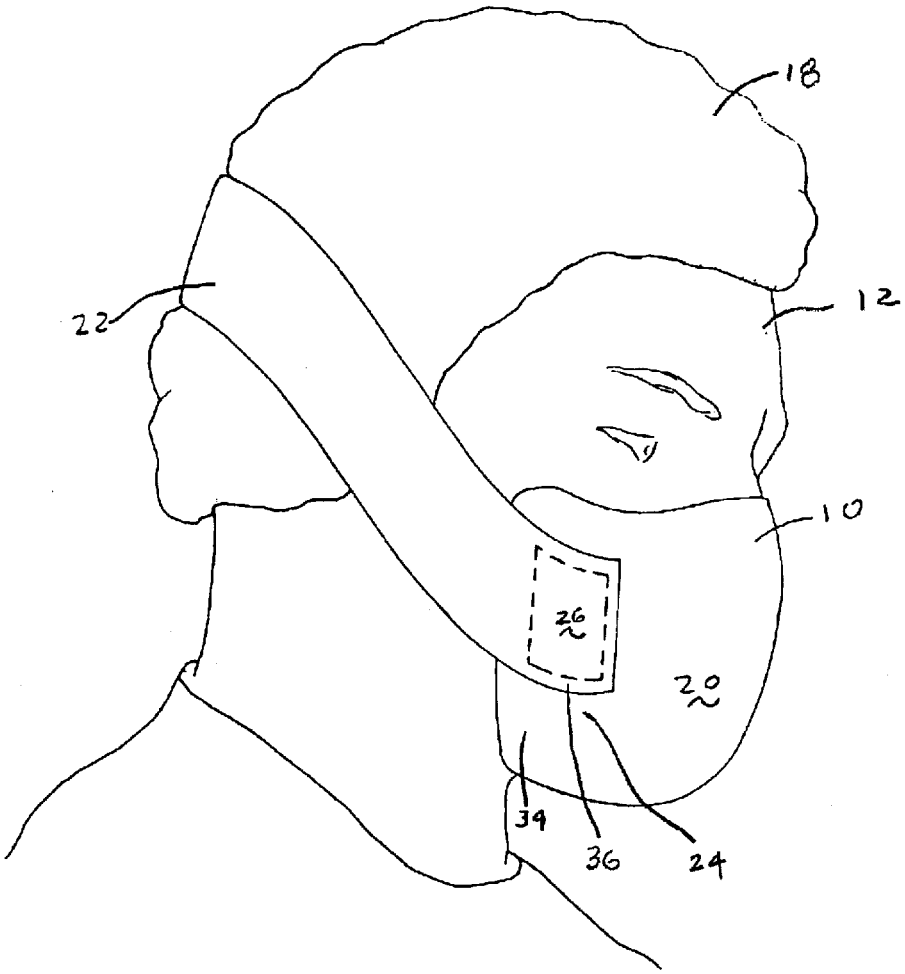
FIG. 10 is an exemplary embodiment of a face mask being shown on the face of a user. The right extension portion of the face mask does not extend around the head of the user.

In certain exemplary embodiments of the present invention, the right or left extension portion 24 and 22 does not extend around the head or the face of the user. FIG. 10 shows such an embodiment where the right extension portion 24 is integrally formed with the body portion 20 and does not extend around the head of the user 12. Here, the left extension portion 22 extends around the left side of the head of the user 12, the back of the head of the user 12, and around the right side of the head of the user 12. The hook and loop type fastener 26 shown in FIG. 10 operates essentially the same as in previous embodiments, the only difference being that the connection point of the hook and loop type fastener 26 occurs closer to the mouth and nose of the user 12. This exemplary embodiment of the present invention provides for removal of the face mask 10 by the user 12 without requiring the user 12 to reach to the back of his or her head. The user 12 need only reach to his or her face or cheek in order to remove the face mask 10 therefrom.

This type of configuration allows for easier donning, adjusting, and removal of the face mask 10 as compared to prior face masks. Again, the potential for contamination through contact with hair or other portions of the user's 12 face or body is reduced or eliminated with the disclosed face mask 10.

Although described as covering the mouth and at least a portion of the nose of the user 12, it is to be understood that in other exemplary embodiments of the present invention that the face mask 10 may be configured to cover the neck, eyes and/or the forehead of the user 12. As such, the face mask 10 may be constructed to cover any portion of the user 12 as demonstrated by previous face masks known in the art. Disengagement of the hook and loop type fastener 26 causes the body portion 20, the right extension portion 24 and the left extension portion 22 to be removed from the user.

The use of the hook and loop type fastener 26 allows for the face mask 10 to be packaged, handled, and attached to the user 12 in a less cumbersome, complex, and time consuming manner than current face masks. The use of the hook and loop type fastener 26 therefore allows for attachment of the face mask 10 to the user 12 to be faster and easier.

The present invention relates to any style or configuration of the face mask 10 that has the hook and loop type fastener 26. The body portion 20 of the face mask 10 may be configured so that it is capable of stretching across the face of the user 12 from ear to ear and/or nose to chin. The ability of the body portion 20 to stretch and recover may provide the face mask 10 with better sealing capabilities and a more comfortable fit than face masks 10 that have an inelastic body portion 20. In order for the body portion 20 to stretch and recover the body portion 20 must have at least one layer or a material that has stretch and recovery properties. Additionally, the entire face mask 10 may be composed of a material that has stretch and recovery properties in other exemplary embodiments of the present invention. In certain exemplary embodiments, the percent recovery is about 15% and the percent stretch is between about 15–65%, in other exemplary embodiments it may be between about 20–40% stretch, and in still other embodiments it may be between about 25–30% stretch.

As mentioned, it should be appreciated that the present invention is not limited to any particular type or style of face mask 10, and that the styles shown in the Figs. are for illustrative purposes only. The hook and loop type fastener 26 disclosed in the present invention may be incorporated into any face mask 10 style or configuration, including rectangular masks, pleated masks, duck bill masks, cone masks, trapezoidal masks, etc. The face mask 10 according to the present invention may also incorporate any combination of known face mask 10 features, such as visors or shields, beard covers, etc. Exemplary faces masks are described and shown, for example, in the following U.S. Pat. Nos. 4,802,473; 4,969,457; 5,322,061; 5,383,450; 5,553,608; 5,020,533; and 5,813,398. These patents are incorporated herein in their entirety by reference for all purposes.

As stated, the mask face 10 may be composed of layers. These layers may be constructed from various materials known to those skilled in the art. For instance, the inner layer of the body portion 20 may be any nonwoven web, such as a spunbonded, meltblown, or coform nonwoven web or a bonded carded web. The inner layer of the body portion 20 and outer layer 50 may be a necked nonwoven web or a reversibly necked nonwoven web. The inner layer of the body portion 20 and the outer layer 50 may be made of the same materials or different materials.

Many polyolefins are available for nonwoven web production, for example polyethylenes such as Dow Chemical's ASPUN® 6811A linear polyethylene, 2553 LLDPE and 25355, and 12350 polyethylene are such suitable polymers. Fiber forming polypropylenes include, for example, Exxon Chemical Company's Escorene® PD 3445 polypropylene and Himont Chemical Co.'s PF-304. Many other suitable polyolefins are commercially available.

The material used in construction of the face mask 10 may be a necked nonwoven web, a reversibly necked nonwoven material, and elastic materials such as an elastic coform material, an elastic meltblown nonwoven web, a plurality of elastic filaments, an elastic film, or a combination thereof. Such elastic materials have been incorporated into composites, for example, in U.S. Pat. No. 5,681,645 to Strack et al., U.S. Pat. No. 5,493,753 to Levy et al., U.S. Pat. No. 4,100,324 to Anderson et al., and in U.S. Pat. No. 5,540,976 to Shawver et al, the contents of which are incorporated herein by reference in their entirety for all purposes. In an exemplary embodiment where an elastic film is used on the body portion 20, the film must be sufficiently perforated to ensure that the user 12 can breathe through the body portion 20.

Elastomeric thermoplastic polymers may be used in the face mask 10 of the present invention and may include block copolymers having the general formula A-B-A' or A-B, where A and A' are each a thermoplastic polymer end block which contains a styrenic moiety such as a poly (vinyl arene) and where B is an elastomeric polymer midblock such as a conjugated diene or a lower alkene polymer. Block copolymers of the A-B-A' type can have different or the same thermoplastic block polymers for the A and A' blocks, and the present block copolymers are intended to embrace linear, branched and radial block copolymers. Examples of useful elastomeric resins include those made from block copolymers such as polyurethanes, copolyether esters, polyamide polyether block copolymers, ethylene vinyl acetates (EVA), block copolymers having the general formula A-B-A' or A-B like copoly(styrene/ethylene-butylene), styrene-poly (ethylene-propylene)-styrene, styrene-poly(ethylene-butylene)-styrene, (polystyrene/poly(ethylene-butylene)/polystyrene, poly(styrene/ethylene-butylene/styrene) and the like. The filter 32 may be made of a meltblown nonwoven web and, in some embodiments, may be an electret. Electret treatment results in a charge being applied to the filter 32 which further increases filtration efficiency by drawing particles to be filtered toward the filter by virtue of their electrical charge. Electret treatment can be carried out by a number of different techniques. One technique is described in U.S. Pat. No. 5,401,446 to Tsai et al. assigned to the University of Tennessee Research Corporation and incorporated herein by reference in its entirety for all purposes. Other methods of electret treatment are known in the art, such as that described in U.S. Pat. No. 4,215,682 to Kubik et al., U.S. Pat. No. 4,375,718 to Wadsworth, U.S. Pat. No. 4,592,815 to Nakao and U.S. Pat. No. 4,874,659 to Ando, the contents of which are incorporated herein by reference in their entirety.

A filter 32 may be made of an expanded polytetrafluoroethylene (PTFE) membrane, such as those manufactured by W. L. Gore & Associates. A more complete description of the construction and operation of such materials can be found in U.S. Pat. No. 3,953,566 to Gore and U.S. Pat. No. 4,187,390 to Gore, the contents of which are incorporated herein by reference in their entirety. The expanded polytetrafluoroethylene membrane may be incorporated into a multilayer composite, including, but not limited to, an outer nonwoven web layer, an extensible and retractable layer, and an inner layer comprising a nonwoven web.

Multiple layers of the face mask 10 may be joined by various methods, including adhesive bonding, thermal bonding, or ultrasonic bonding. Additionally, the hook and loop type fastener 26 may be affixed to the face mask 10 by one or more of these previously mentioned methods of joining the layers of the face mask 10.

The body portion 20 of the face mask 10 and/or the left and/or right extension portions 22 and 24 may be made of a composite that is a neck boned laminate in certain exemplary embodiments of the present invention. The neck bonded laminate may utilize a necked material or a reversibly necked material. The necking process typically involves unwinding a material from a supply roll and passing it through a brake nip roll assembly at a given linear speed. A take-up roll or nip, operating at a linear speed greater than that of the brake nip roll, draws the material and generates the tension needed to elongate and neck the fabric. When a reversibly necked material is desired, the stretched material is heated and cooled while in a stretched condition. The heating and cooling of the stretched material causes additional crystallization of the polymer and imparts a heat set. The necked material or reversibly necked material is then bonded to an elastic material. The resulting necked composite is extensible and retractable in the cross-machine direction, that is the direction perpendicular to the direction the material is moving when it is produced. Upon extension and release, the elastic material provides the force needed for the extended composite to retract. A composite of multiple layers may also be formed in this fashion, either simultaneously or step-wise. As an illustration, to construct a four-layer composite, a layer of a spunbonded nonwoven, another layer of a spunbonded nonwoven, and a meltblown nonwoven material are individually necked by the process detailed above. The layers are then positioned as desired and thermally bonded to an elastomeric meltblown web. The resulting composite is extensible and retractable in at least one direction.

In another exemplary embodiment, the composite may be a stretch bonded laminate. A stretch bonded laminate is formed by providing an elastic material, such as a nonwoven web, filaments, or film, extending the elastic material, attaching it to a gatherable material, and releasing the resulting laminate. A stretch bonded laminate is extensible and retractable in the machine direction, that is the direction that the material is moving when it is produced. A composite with multiple layers may be formed by providing the elastic layer and the gatherable layers, and subjecting it to this process either simultaneously or stepwise. The stretch bonded laminate may also include a necked material that is extensible and retractable in the cross-direction such that the overall laminate is extensible and retractable in at least two dimensions. As an illustration, to construct a two-layer composite that is extensible and retractable in at least two dimensions, an elastomeric meltblown nonwoven web is provided, the elastomeric meltblown nonwoven web is then extended in the machine direction, and the necked spunbonded nonwoven material is attached to the elastomeric meltblown nonwoven web by thermal bonding while the elastomeric meltblown web is extended. When the biasing force is released, the resulting composite is extensible and retractable in both the cross-direction and machine direction, due to the extensibility of the necked material and the use of the stretch bonding process, respectively.

Additional examples of processes to make such composites are described in, but not limited to, U.S. Pat. No. 5,681,645 to Strack et al., U.S. Pat. No. 5,492,753 to Levy et al., U.S. Pat. No. 4,100,324 to Anderson et al., and in U.S. Pat. No. 5,540,976 to Shawver et al., the contents of which are incorporated herein by reference in their entirety for all purposes.

The composite may contain various chemical additives or topical chemical treatments in or on one or more layers, including, but not limited to, surfactants, colorants, antistatic chemicals, antifogging chemicals, fluorochemical blood or alcohol repellents, lubricants, or antimicrobial treatments.

It should be understood that the present invention includes various modifications that can be made to the exemplary embodiments of the face mask 10 described herein as come within the scope of the appended claims and their equivalents.

What is claimed is:

1. A face mask, comprising:

a body portion configured to be placed over a mouth and at least part of a nose of a user in order to at least partially isolate the mouth and the at least part of the nose of the user from the environment, said body portion configured to contact the nose of the user, and said body portion having a filter that is non-removably attached to said body portion so as to be non-removably located at the part of said body portion configured to at least partially isolate at least part of the nose of the user from the environment;

a left extension of said body portion configured to extend around at least a portion of the left side of the user's head;

a right extension of said body portion configured to extend around at least a portion of the right side of the user's head;

a hook and loop type fastener having a hook section and a loop section, said hook section being attached to one of said right or left extension portions, and said loop section being attached to the other of said right or left extension portions; and wherein engagement of said hook and loop sections causing said left and right extension portions to be connected to one another and causing said body portion, said right extension portion, and said left extension portion to be retained on the user such that said filter is drawn towards the nose of the user.

2. The face mask of claim 1, wherein said left extension portion is formed integrally with said body portion, and is made of the same material as at least a portion of said body portion.

3. The face mask of claim 1, wherein said right extension portion is formed integrally with said body portion, and is made of the same material as at least a portion of said body portion.

4. The face mask of claim 1, wherein said hook section is formed integrally with one of said right or left extension portions.

5. The face mask of claim 1, wherein said loop section is formed integrally with one of said right or left extension portions.

6. The face mask of claim 1, wherein said hook section is a separate component that is attached to one of said right or left extension portions.

7. The face mask of claim 1, wherein said loop section is a separate component that is attached to one of said right or left extension portions.

8. The face mask of claim 1, wherein said loop section and said hook section are substantially the same size.

9. The face mask of claim 1, wherein said loop section and said hook section are of different sizes.

10. The face mask of claim 1, wherein said left extension portion and said right extension portion are made of an elastic material.

11. The face mask of claim 1, wherein said left extension portion and said right extension portion are made of a substantially inelastic material.

12. The face mask of claim 1, wherein said body portion carrying at least one stay for providing structural rigidity to said body portion.

13. A face mask, comprising:

a body portion configured to be placed over a mouth and at least part of a nose of a user, said body portion configured to contact the nose of the user, and said body portion having a filter that is non-removably attached to said body portion so as to be non-removably located at the part of the body portion configured to contact the nose of the user;

a first extension of said body portion and configured to at least partially extend around at least a portion of a head of the user;

a second extension of said body portion;

a hook and loop type fastener having a hook section and a loop section, one of said hook and loop sections being attached to said first extension portion, and the other of said hook and loop sections being attached to said second extension portion;

wherein engagement of said hook section and said loop section causing said body portion, said first extension portion, and said second extension portion to be retained on the user, such that said filter is drawn towards the nose of the user; and wherein disengagement of said hook section and said loop section causing said body portion, said first extension portion, said second extension portion, and said filter to be released from the user.

14. The face mask of claim 13, wherein said second extension portion being configured to at least partially extend around at least a portion of a head of the user.

15. The face mask of claim 13, wherein said first extension portion is formed integrally with said body portion.

16. The face mask of claim 13, wherein said second extension portion is formed integrally with said body portion.

17. The face mask of claim 13, wherein said hook section is formed integrally with one of said first or second extension portions.

18. The face mask of claim 13, wherein said loop section is formed integrally with one of said first or second extension portions.

19. The face mask of claim 13, wherein said hook section is a separate component that is attached to one of said first or second extension portions.

20. The face mask of claim 13, wherein said loop section is a separate component that is attached to one of said first or second extension portions.

21. The face mask of claim 13, wherein said loop section and said hook section are substantially the same size.

22. The face mask of claim 13, wherein said loop section and said hook section are of different sizes.

23. The face mask of claim 14, wherein said first extension portion and said second extension portion are made of an elastic material.

24. The face mask of claim 13, wherein at least one of said first extension portion and said second extension portion are made of a substantially inelastic material.

25. The face mask of claim 13, wherein said body portion carrying at least one stay for providing structural rigidity to said body portion.

26. A face mask, comprising:

a body portion configured to be placed over a mouth and at least part of a nose of a user in order to at least partially isolate the mouth and the at least part of the nose of the user from the environment, said body portion configured to contact the nose of the user, and said body portion having a filter that is non-removably attached to said body portion so as to be non-removably located at the part of said body portion configured to at least partially isolate at least part of the nose of the user from the environment;

a first extension of said body configured to extend around at least a portion of the head of the user, said first extension portion being made of an elastic material;

a second extension of said body configured to extend around at least a portion of the head of the user, said second extension portion being made of an elastic material;

a hook and loop type fastener having a hook section and a loop section, said hook section and said loop section being substantially the same in size, said hook section being a separate component attached to said first extension portion, and said loop section being a separate component attached to said second extension portion;

wherein engagement of said hook section and said loop section causing said body portion, said first extension portion, and said second extension portion to be retained on the user, such that said filter is drawn towards the nose of the user; and wherein disengagement of said hook section and said loop section causing said body portion, said first extension portion, said second extension portion, and said filter to be released from the user.

* * * * *